US005476608A

United States Patent [19]

Boyer et al.

[11] Patent Number: 5,476,608

[45] Date of Patent: Dec. 19, 1995

[54] LIQUID LAUNDRY DETERGENTS WITH CITRIC ACID, CELLULASE, AND BORICDIOL COMPLEX TO INHIBIT PROTEOLYTIC ENZYME

[75] Inventors: Stanton L. Boyer, Fairfield; Timothy J. Farwick, Cincinnati, both of Ohio

[73] Assignee: The Procter & Gamble Company, Cincinnati, Ohio

[21] Appl. No.: 243,024

[22] Filed: May 16, 1994

Related U.S. Application Data

[63] Continuation of Ser. No. 803,310, Dec. 4, 1991, abandoned.

[51] Int. Cl.[6] ..... C11D 3/386

[52] U.S. Cl. ..... 252/135; 252/134; 252/174.12; 252/DIG. 12; 252/549; 252/550; 435/188

[58] Field of Search ..... 252/174.12, DIG. 12, 252/135, 136, 174.21, 549–550; 435/188

[56] References Cited

U.S. PATENT DOCUMENTS

| | | | |
|---|---|---|---|
| 4,404,115 | 9/1983 | Tai | 252/135 |
| 4,435,307 | 3/1984 | Barbesgaard et al. | 252/174.12 |
| 4,537,707 | 8/1985 | Severson, Jr. | 252/545 |
| 4,566,985 | 1/1986 | Bruno et al. | 252/174.12 |
| 4,652,394 | 3/1987 | Inamoralo et al. | 252/174.12 |
| 4,842,758 | 6/1989 | Crutzen | 252/817 |
| 4,842,769 | 6/1989 | Shulman et al. | 252/8.6 |
| 4,900,475 | 2/1990 | Ramachandran et al. | 252/532 |
| 5,174,292 | 12/1992 | Honsa et al. | 252/543 |

FOREIGN PATENT DOCUMENTS

| | | | |
|---|---|---|---|
| 0080223 | 6/1983 | European Pat. Off. . | |
| 87202189.4 | 6/1988 | European Pat. Off. . | |
| 0293881 | 12/1988 | European Pat. Off. . | |
| 0344828 | 12/1989 | European Pat. Off. . | |
| 0376705 | 4/1990 | European Pat. Off. . | |
| 0381262 | 8/1990 | European Pat. Off. . | |
| 2247832 | 6/1984 | Germany . | |
| 3918761 | 6/1990 | Germany . | |
| 2075028 | 11/1981 | United Kingdom . | |
| 2079305 | 1/1982 | United Kingdom | 252/174.12 |
| 2095275 | 9/1982 | United Kingdom . | |
| WO91/17243 | 11/1991 | WIPO . | |
| 9117243 | 11/1991 | WIPO | 252/174.12 |

OTHER PUBLICATIONS

"Equilibria Between Borate Ion and Some Polyols in Aqueous Solution" by Conner, J. M. and Bulgrin, V. C., *J. Inorg. Nucl. Chem.*, vol. 29, pp. 1953–1961, (1967).

"Studies on Borate Esters I" by Van Duin, M., Peters, J. A., Kieboom, A. P. G., and Van Bekkum, H., from *Tetrahedron*, vol. 40, No. 15, pp. 2901–2911 (1984).

"Raman Study of Aqueous Monoborate–Polyol Complexes. Equilibria in the Monoborate–1,2–Ethanediol System" by Oertel, R. P., *Inorganic Chemistry*, vol. II, No. 3, pp. 544–549 (1972).

"Mechanism of the Complexation of Boron Acids with Catechol and Substituted Catechols" by Pizer, R. and Babcock, L., *Inorganic Chemistry*, vol. 16, No. 7 pp. 1677–1681 (1977).

Philipp, M. and Bender, M. L., "Kinetics of Subtilisin and Thiolsubtilisin", Molecular & Cellular Biochemistry, vol. 51, pp. 5–32 (1983).

*Primary Examiner*—Paul Lieberman
*Assistant Examiner*—Kery Fries
*Attorney, Agent, or Firm*—Beth Goldstein Lewis; Mary Pat McMahon

[57] ABSTRACT

Liquid laundry detergent compositions containing anionic or nonionic surfactant, citric acid or a water-soluble salt thereof, proteolytic enzyme, cellulase, and a mixture of 1,2 propane diol and boric acid or its derivative. The compositions are prepared by adding the diol and boric acid before adding the citric acid/salt to the composition. This order of addition improves the stability of the cellulase.

17 Claims, No Drawings

LIQUID LAUNDRY DETERGENTS WITH CITRIC ACID, CELLULASE, AND BORICDIOL COMPLEX TO INHIBIT PROTEOLYTIC ENZYME

This is a continuation of application Ser. No. 07/803,310, filed on Dec. 4, 1991, now abandoned.

FIELD OF THE INVENTION

This invention relates to liquid laundry detergent compositions containing anionic or nonionic surfactant, citric acid or a water-soluble salt thereof, proteolytic enzyme, cellulase, 1,2 propane diol (hereinafter also referred to as diol) and boric acid or its derivative (hereinafter also referred to as boric acid). The compositions are prepared by adding the diol and boric acid to the composition before adding the citric acid/salt to the composition. This order of addition improves the stability of the cellulase in the presence of the proteolytic enzyme.

BACKGROUND OF THE INVENTION

A commonly encountered problem with protease-containing liquid detergents is the degradation of other enzymes in the composition by the proteolytic enzyme. The stability of the other enzyme upon storage and its performance can be impaired by the proteolytic enzyme.

Boric acid and boronic acids are known to reversibly inhibit proteolytic enzymes. A discussion of the inhibition of one serine protease, subtilisin, by boronic acid is provided in Philipp, M. and Bender, M. L., "Kinetics of Subtilisin and Thiolsubtilisin", Molecular & Cellular Biochemistry, vol. 51, pp. 5–32 (1983).

One class of boronic acid, peptide boronic acid, is discussed as an inhibitor of trypsin-like serine proteases, especially in pharmaceuticals, in European Patent Application 0 293 881, Kettner et al., published Dec. 7, 1988.

In liquid detergents built with citric acid or a water-soluble salt thereof, boric acid appears to complex with the citric acid/salt. It is believed that this adversely affects boric acid's function as a proteolytic enzyme inhibitor. The proteolytic enzyme then is free to degrade cellulase in the composition, rendering it less effective. The extent to which the citric acid/salt complexes with a boric acid derivative is believed to be a function of the type of derivative employed in the composition.

The effectiveness of boric acid as a proteolytic enzyme inhibitor can be increased by the addition of 1,2 propane diol. Without intending to be limited by theory, it is believed that a predominantly 1:1 molar boric/diol complex is formed which is capable of binding with the active site (serine) on the proteolytic enzyme and inhibiting it.

However, it has been found that the addition of boric acid to liquid detergents containing citric acid/salt and 1,2 propane diol does not significantly improve cellulase stability in the presence of protease unless the boric acid and diol are added to the composition prior to the citric acid. With this order of addition, the boric/diol mixture is an effective protease inhibitor even in the presence of citric acid or a salt thereof. This minimizes degradation of the cellulase by the proteolytic enzyme. Upon dilution in water, such as under typical wash conditions, the proteolytic enzyme is no longer inhibited and can function to remove protease-sensitive stains from fabrics. The importance of adding boric acid and diol to liquid detergent compositions containing proteolytic enzyme and cellulase prior to adding citric acid/salt is not disclosed by the art. It is particularly surprising that the citric acid/salt does not render the boric/diol complex ineffective for protease inhibition over time.

European Patent Application 0 381 262, Aronson et al, published Aug. 8, 1990, discloses mixtures of proteolytic and lipolytic enzymes in a liquid medium. The stability of lipolytic enzyme is said to be improved by the addition of a stabilizer system comprising boron compound and a polyol capable of reacting with it, whereby the polyol has a first binding constant of at least 500 l/mole and a second binding constant with the boron compound of at least 1000 $l^2$/$mole^2$.

German Patent 3 918 761, Weiss et al, published Jun. 28, 1990, discloses a liquid enzyme concentrate which is said to be usable as a raw material solution for making liquid detergents and the like. The concentrate contains hydrolase, propylene glycol and boric acid or its soluble salt.

U.S. Pat. No. 4,900,475, Ramachandran et al, issued Feb. 13, 1990, discloses a stabilized enzyme-containing detergent containing surfactant, builder salt and an effective amount of enzyme or enzyme mixture containing protease and alpha-amylase enzymes. The composition also contains a stabilization system comprised of glycerine, a boron compound and a carboxylic compound with 2–8 carbon compounds.

U.S. Pat. No. 4,537,707, Severson, Jr., issued Aug. 27, 1985, describes heavy duty liquid detergents containing anionic surfactant, fatty acid, builder, proteolytic enzyme, boric acid, calcium ions and formate. The combination of boric acid and formate provides improved proteolytic enzyme stability in the compositions.

European Patent Application 0 080 223, Boskamp et al, published Jun. 1, 1983, describes aqueous enzymatic detergent compositions containing boric acid or an alkali metal borate with a polyfunctional amino compound or a polyol, together with a reducing alkali metal salt.

Similarly, in GB 2 079 305, Boskamp, published Jan. 20, 1982, it is disclosed that enhanced enzyme stability can be obtained in a built liquid detergent composition by inclusion of a mixture of boric acid and polyol in a weight ratio of more than 1:1, and a cross linked neutralized polyacrylate polymer.

SUMMARY OF THE INVENTION

The present invention relates to a liquid laundry detergent composition comprising, by weight:

a. from about 5 to 50% of anionic or nonionic surfactant, at least about 25% of which is an ethoxylated or sugar-based surfactant;

b. from about 1 to 10% of citric acid, or a water-soluble salt thereof;

c. from about 1 to 20% of 1,2 propane diol;

d. from about 0.5 to 5% of boric acid or its derivative;

e. from 0.0001 to 1.0% of active proteolytic enzyme;

f. from about 0.0001 to 1.0% of active cellulase enzyme; and g. from about 10 to 75% of water;

wherein said composition is prepared by adding the 1,2 propane diol and boric acid or its derivative to the composition before adding the citric acid or salt thereof to the composition.

DESCRIPTION OF THE INVENTION

The liquid laundry detergent compositions herein contain anionic or nonionic surfactant, or mixtures thereof, citric acid or a water-soluble salt thereof, 1,2 propane diol, boric acid or its derivative, proteolytic enzyme, cellulase, and water. The compositions are prepared by adding the 1,2 propane diol and boric acid or its derivative to the composition before adding the citric acid or salt to the composition. This order of addition significantly increases the stability of the cellulase in the presence of the proteolytic enzyme.

Surfactant

The compositions of the invention contain from about 5 to 50, preferably about 10 to 40, most preferably about 12 to 30, weight % of anionic or nonionic surfactant. Mixtures of such surfactants are also contemplated herein. It is preferred that no significant amount of surfactant other than anionic and nonionic surfactants be included.

The preferred cellulase herein is denatured by alkyl sulfate and linear alkylbenzene sulfonate anionic surfactants. Ethoxylated and sugar-based surfactants prevent such denaturing of the cellulase. It is therefore preferred that at least 25%, preferably at least 50%, more preferably at least 75%, by weight of the surfactant is an ethoxylated and/or sugar-based anionic or nonionic surfactant.

Preferred anionic surfactants herein include $C_{12}$–$C_{18}$ alkyl sulfates and $C_{11}$–$C_{13}$ linear alkylbenzene sulfonates for good cleaning performance, and $C_{12}$–$C_{18}$ alkyl sulfates ethoxylated with an average of from about 1 to 6 moles of ethylene oxide per mole of alky sulfate for good cleaning and to minimize denaturing of the cellulase by alkyl sulfate and alkylbenzene sulfonate surfactants. Preferably the nonionic surfactant is a condensation product of $C_{10}$–$C_{18}$ alcohol and between 2–20 (preferably about 5 to 12) moles of ethylene oxide per mole of alcohol, or a polyhydroxy $C_{12-18}$ (preferably $C_{11-15}$) fatty acid amide. The above and other surfactants useful herein are described in more detail hereinafter.

Anionic Surfactants

Alkyl ester sulfonate surfactants can be utilized in the invention. These are desirable because they can be made with renewable, non-petroleum resources. Preparation of the alkyl ester sulfonate surfactant component is according to known methods disclosed in the technical literature. For instance, linear esters of $C_8$–$C_{20}$ carboxylic acids can be sulfonated with gaseous $SO_3$ according to "The Journal of the American Oil Chemists Society," 52 (1975), pp. 323–329. Suitable starting materials would include natural fatty substances as derived from tallow, palm, and coconut oils, etc.

The preferred alkyl ester sulfonate surfactant is of the structural formula:

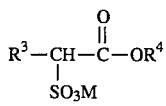

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a soluble salt-forming cation. Suitable salts include metal salts such as sodium, potassium, and lithium salts, and substituted or unsubstituted ammonium salts, such as methyl-, dimethyl, -trimethyl, and quaternary ammonium cations, e.g. tetramethyl-ammonium and dimethyl piperydinium, and cations derived from alkanolamines, e.g. monoethanolamine, diethanolamine, and triethanolamine. Preferably, $R^3$ i s $C_{10}$–$C_{16}$ alkyl, and $R^4$ is methyl, ethyl or isopropyl. Especially preferred are the methyl ester sulfonates wherein $R^3$ is $C_{14}$–$C_{16}$ alkyl.

Alkyl sulfate surfactants are another type of anionic surfactant for use herein. Included are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), substituted or unsubstituted ammonium cations such as methyl-, dimethyl-, and trimethyl ammonium and quaternary ammonium cations, e.g., tetramethyl-ammonium and dimethyl piperdinium, and cations derived from alkanolamines such as ethanolamine, diethanolamine, triethanolamine, and mixtures thereof, and the like. Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Alkyl alkoxylated sulfate surfactants are another category of useful anionic surfactant. These surfactants are water soluble salts or acids typically of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy (preferred) or propoxy unit, m is greater than zero, typically between about 0.5 and about 20, more preferably between about 1 and about 4, and M is H or a cation which can be, for example, a metal cation (e.g., sodium, potassium, lithium, calcium, magnesium, etc.), ammonium or substituted-ammonium cation. Specific examples of substituted ammonium cations include methyl-, dimethyl-, trimethyl-ammonium and quaternary ammonium cations, such as tetramethyl-ammonium, dimethyl piperydinium and cations derived from alkanolamines, e.g. monoethanolamine, diethanolamine, and triethanolamine, and mixtures thereof. Exemplary surfactants are $C_{12}$–$C_{18}$ alkyl polyethoxylate (1.0) sulfate, $C_{12}$–$C_{18}$ alkyl polyethoxylate (2.25) sulfate, $C_{12}$–$C_{18}$ alkyl polyethoxylate (3.0) sulfate, and $C_{12}$–$C_{18}$ alkyl polyethoxylate (4.0) sulfate, wherein M is conveniently selected from sodium and potassium.

Alkyl ethoxy carboxylate surfactants of this invention are of the formula $$RO(CH_2CH_2O)_xCH_2COO^-M^+$$

wherein R is a $C_8$ to $C_{18}$ (preferably $C_{12}$–$C_{18}$) alkyl group, x is a number averaging from about 1 to 15, (preferably about 2 to 6), and M is an alkali metal or an alkaline earth metal cation (preferably sodium or potassium). The alkyl chain having from about 8 to about 18 carbon atoms can be drived from fatty alcohols, olefins, etc. Normally, and preferably, the alkyl chain will be a mixture of alkyl chains. However, pure alkyl chains can be used. The alkyl chain is desirably a straight saturated alkyl chain, but it may also be a branched and/or unsaturated alkyl chain. These surfactants and methods of making them are described in European Patent Application 90305468.2, published Nov. 28, 1990, incorporated herein by reference.

Other anionic surfactants that can be included in the compositions are the salts (including, for example, sodium, potassium, ammonium, and substituted ammonium salts such as mono-, di- and triethanolamine salts) of soap, $C_9$–$C_{20}$ linear alkylbenzene sulphonates, $C_8$–$C_{22}$ primary or secondary alkane sulphonates, $C_8$–$C_{24}$ olefin sulphonates, sulphonated polycarboxylic acids prepared by sulphonation of the pyrolyzed product of alkaline earth metal citrates, e.g., as described in British Patent Specification No. 1,082,179, alkyl glycerol sulfonates, fatty acyl glycerol sulfonates, fatty oleyl glycerol sulfates, alkyl phenol ethylene oxide ether sulfates, paraffin sulfonates, alkyl phosphates, isothionates such as the acyl isothionates, N-acyl taurates, fatty acid amides of methyl tauride, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates, sulfates of alkylpolysaccharides such as the sulfates of alkylpolyglucoside (the nonionic nonsulfated compounds being described below), branched primary alkyl sulfates, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughl i n, et al. at Column 23, line 58 through Column 29, line 23 (incorporated herein by reference).

Nonionic Surfactants

Suitable nonionic detergent surfactants are generally disclosed in U.S. Pat. No. 3,929,678, Laughl in et al., issued Dec. 30, 1975, at column 13, line 14 through column 16, line 6, incorporated herein by reference. Exemplary, non-limiting classes of useful nonionic surfactants are listed below.

1. The polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include Igepal™ CO-630, marketed by the GAF Corporation; and Triton™ X-45, X-114, X-100, and X-102, all marketed by the Rohm & Haas Company. These compounds are commonly referred to as alkyl phenol alkoxylates, (e.g., alkyl phenol ethoxylates).
2. The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 18 moles of ethylene oxide per mole of alcohol. Examples of commercially available nonionic surfactants of this type include Tergitol™ 15-S-9 (the condensation product of $C_{11}$–$C_{15}$ linear secondary alcohol with 9 moles ethylene oxide), Tergitol™ 24-L-6 NMW (the condensation product of $C_{12}$–$C_{14}$ primary alcohol with 6 moles ethylene oxide with a narrow molecular weight distribution), both marketed by Union Carbide Corporation; Neodol™ 45-9 (the condensation product of $C_{14}$–$C_{15}$ linear alcohol with 9 moles of ethylene oxide), Neodol™ 23-6.5 (the condensation product of $C_{12}$–$C_{13}$ linear alcohol with 6.5 moles of ethylene oxide), Neodol™ 45-7 (the condensation product of $C_{14}$–$C_{15}$ linear alcohol with 7 moles of ethylene oxide), Neodol™ 45-4 (the condensation product of $C_{14}$–$C_{15}$ linear alcohol with 4 moles of ethylene oxide), marketed by Shell Chemical Company, and Kyro™ EOB (the condensation product of $C_{13}$–$C_{15}$ alcohol with 9 moles ethylene oxide), marketed by The Procter & Gamble Company. This category of nonionic surfactant is referred to generally as "alkyl ethoxylates."
3. The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic™ surfactants, marketed by BASF.
4. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic™ compounds, marketed by BASF.
5. Semi-polar nonionic surfactants, including water-soluble amine oxides containing one alkyl moiety of from about 10 to about 18 carbon atoms and 2 moieties selected from the group consisting of alkyl groups and hydroxyalkyl groups containing from about 1 to about 3 carbon atoms. Preferred amine oxide surfactants are $C_{10}$–$C_{18}$ (most preferably $C_{12}$–$C_{16}$) alkyl dimethyl amine oxides.
6. Sugar-based, nonionic surfactants such as alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1 to about 10, preferably from about 1.3 to about 3, saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to about 3 hydroxy groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1 to about 10, preferably from about 1.3 to about 3. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position.

7. Fatty acid amide surfactants having the formula:

$$R^6-\overset{\overset{\displaystyle O}{\|}}{C}-N(R^7)_2$$

wherein $R^6$ is an alkyl group containing from about 7 to about 21 (preferably from about 9 to about 17) carbon atoms and each $R^7$ is selected from the group consisting of hydrogen, $C_1$–$C_4$ alkyl, $C_1$–$C_4$ hydroxyalkyl, and $-(C_2H_4O)_xH$ where x varies from about 1 to about 3. Preferred amides are $C_8$–$C_{20}$ ammonia amides, monoethanolamides, diethanolamides, and isopropanolamides.

8. Polyhydroxy fatty acid amide surfactants of the structural formula:

$$R^2-\overset{\overset{\displaystyle O}{\|}}{C}-\overset{\overset{\displaystyle R^1}{|}}{N}-Z \qquad \text{(I)}$$

wherein $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{15}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $-CH_2-(CHOH)_n-CH_2OH$, $-CH(CH_2OH)-(CHOH)_{n-1}-CH_2OH$, $-CH_2-(CHOH)_2(CHOR')(CHOH)-CH_2OH$, and alkoxylated derivatives thereof, where n is an integer from 3 to 5, inclusive, and R' is H or a cyclic or aliphatic monosaccharide. Most preferred are glycityls wherein n is 4, particularly $-CH_2(CHOH)_4-CH_2OH$.

In the above formula, R' can be, for example, N-methyl, N-ethyl, N-propyl, N-isopropyl, N-butyl, N-2-hydroxy ethyl, or N- 2-hydroxy propyl.

$R^2-CO-N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1 -deoxylactityl, 1-deoxygalactityl, 1-deoxymannityl, 1 -deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

Citric Acid

The compositions herein further contain from about 1 to 10, preferably about 1.5 to 8, weight % of citric acid. Water-soluble salts of citric acid (particularly sodium salt), are also useful in the liquid detergent compositions herein.

Diol/Boric Mixture

The liquid detergent compositions herein contain a mixture of 1,2 propane diol and boric acid or its derivative. The final concentration of boric acid or its derivative in the detergent composition is between about 0.5 and 5% by weight and the final concentration of 1,2 propanediol is between about 1 and 20% by weight. Preferably, the concentration of boric acid or its derivative in the composition is between about 1 and 4 weight %, and most preferably between about 1.5 and 3 weight %. The concentration of diol in the composition is preferably between about 3 and 15, most preferably between about 5 and 12, weight %.

The diol/boric weight ratio is preferably between about 1:1 and 20:1, more preferably between about 2:1 and 10:1. This insures sufficient diol to form the preferred 1:1 molar diol/boric complex, while providing additional diol to aid in the dissolution of other ingredients during processing and storage.

Suitable boric acid derivatives include borax, boric oxide, polyborates, orthoborates, pyroborates, and metaborates, or mixtures thereof. Preferred compounds are the alkali salts of boric acid, such as sodium borate, and amine salts thereof, such as the monoethanol salt of boric acid. These salts can be formed in the formulation by in-situ neutralization of boric acid with an appropriate alkali or amine.

Proteolytic Enzyme

The liquid detergent compositions herein also contain from about 0.0001 to 1.0, preferably about 0.0005 to 0.3, most preferably about 0.002 to 0.1, weight % of active proteolytic enzyme. Mixtures of proteolytic enzyme are also included. The proteolytic enzyme can be of animal, vegetable or microorganism (preferred) origin. More preferred is serine proteolytic enzyme of bacterial origin. Purified or nonpurified forms of this enzyme can be used. Proteolytic enzymes produced by chemically or genetically modified mutants are included. Particularly preferred is bacterial serine proteolytic enzyme obtained from *Bacillus subtilis* and/or *Bacillus licheniformis*.

Suitable proteolytic enzymes include Alcalase®, Esperase®, Savinase®, Maxatase®, Maxacal®, Maxapem 15®, and subtilisin BPN and BPN', which are commercially available. Preferred proteolytic enzymes are also modified bacterial serine proteases, such as those described in European Patent Application Serial Number 87 303761.8, filed Apr. 28, 1987 (particularly pages 17, 24 and 98), particularly "Protease B" therein, and in European Patent Application 199,404, Venegas, published Oct. 29, 1986, which refers to a modified bacterial serine proteolytic enzyme called "Protease A" therein.

Cellulase

The third essential ingredient in the present liquid compositions is a cellulase enzyme. It can be a bacterial or fungal cellulase.

The amount of cellulase used in the composition varies according to the type of cellulase and the use intended. In general, from about 0.0001 to 1.0, more preferably 0.0002 to 0.5, weight % on an active basis of the cellulase is used. Preferably, the cellulase will have a pH optimum of between 5 and 9.5. The level of the cellulase is such that the amount of enzyme protein to be delivered in the wash solution is preferably from 0.005 to 40 mg/liter of wash solution, more preferably 0.01 to 10 mg/liter of wash solution.

Suitable cellulases are disclosed in U.S. Pat. No. 4,435,307, Barbesgaard et al., issued Mar. 6, 1984, incorporated herein by reference, which discloses fungal cellulase produced from *Humicola insolens*. Suitable cellulases are also disclosed in GB-A-2.075.028, GB-A-2.095.275 and DE-OS-2.247.832, all incorporated herein by reference.

Examples of such cellulases are cellulases produced by a strain of *Humicola insolens* (*Humicola grisea* var. *thermoidea*), particularly the Humicola strain DSM 1800, and cellulases produced by a fungus of Bacillus N or a cellulase 212-producing fungus belonging to the genus Aeromonas, and cellulase extracted from the hepatopancreas of a marine mollusc (Dolabella Auricula Solander).

Activity determination for the cellulase herein is based on the hydrolysis of carboxymethyl cellulose. Generated reducing carbohydrates are colorimetrically determined by the ferrocyanide reaction as described by W. S. Hoffman "J. Biol. Chem." 120,51 (1973). Key conditions of incubation are pH=7.0, temperature of 40° C. and incubation time of 20 minutes.

One CMCase unit is defined as the amount of enzyme which forms per minute an amount of reducing carbohydrate equivalent to $10^{-6}$ mole of glucose, in the above-described conditions.

A useful range of cellulase activity in the present context is from 0.01 to 1360, preferably from 0.1 to 140 CMCase activity units/gram of detergent composition.

A preferred cellulase herein consists essentially of a homogenous endoglucanase component which is immunoreactive with an antibody raised against a highly purified about 43 kD endoglucanase derived from *Humicola insolens*, DSM 1800, or which is homologous to said about 43 kD endoglucanase. The endoglucanase component preferably has an endoglucanase activity of at least 50 CMC-endoase units/mg of protein, more preferably at least 60 CMC-endoase units/mg of total protein, in particular at least 90 CMC-endoase units/mg of total protein, and most preferably at least 100 CMC-endoase units/mg of total protein. The endoglucanase component preferably has an isoelectric point of about 5.1.

Such cellulases and methods for their preparation are described in PCT International Publication Number WO 91/17243, published Nov. 14, 1991, by Novo Nordisk A/S, incorporated herein by reference.

Water

The present compositions contain from about 10% to about 75%, preferably from about 25% to about 60%, by weight of water.

Optional Ingredients

Other Detergency Builders

In addition to the citric acid/salt described above, the composition may contain from 0 to about 50, more preferably about 2 to 30, most preferably about 3 to 15, weight percent of other detergency builders. Inorganic as well as organic builders can be used.

Inorganic detergency builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates.

Organic detergent builders preferred for the purposes of the present invention include a wide variety of polycarboxylate compounds. As used herein, "polycarboxylate" refers to compounds having a plurality of carboxylate groups, preferably at least two carboxylates.

Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of s polycarboxylate builders encompasses the ether polycarboxylates. A number of ether polycarboxylates have been disclosed for use as detergent builders. Examples of useful ether polycarboxylates include oxydisuccinate, as disclosed in Berg, U.S. Pat. No. 3,128,287, issued Apr. 7, 1964, and Lamberti et al., U.S. Pat. No. 3,635,830, issued Jan. 18, 1972, both of which are incorporated herein by reference.

Still other ether polycarboxylates include copolymers of maleic anhydride with ethylene or vinyl methyl ether, 1,3, 5-trihydroxy benzene-2,4,6-trisulphonic acid, and carboxymethyloxysuccinic acid.

Organic polycarboxylate builders also include the various alkali metal, ammonium and substituted ammonium salts of polyacetic acids. Examples include the sodium, potassium, lithium, ammonium and substituted ammonium salts of ethylenediamine tetraacetic acid, and nitrilotriacetic acid.

Also included are polycarboxylates such as mellitic acid, succinic acid, oxydisuccinic acid, polymaleic acid, benzene 1,3,5-tricarboxylic acid, and carboxymethyloxysuccinic acid, and soluble salts thereof.

Other carboxylate builders include the carboxylated carbohydrates disclosed in U.S. Pat. No. 3,723,322, Diehl, issued Mar. 28, 1973, incorporated herein by reference.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986, incorporated herein by reference. Useful succinic acid builders include the $C_5$–$C_{20}$ alkyl succinic acids and salts thereof. A particularly preferred compound of this type is dodecenylsuccinic acid. Alkyl succinic acids typically are of the general formula R—CH(COOH)$CH_2$(COOH) i.e., derivatives of succinic acid, wherein R is hydrocarbon, e.g., $C_{10}$–$C_{20}$ alkyl or alkenyl, preferably $C_{12}$–$C_{16}$ or wherein R may be substituted with hydroxyl, sulfo, sulfoxy or sulfone substituents, all as described in the above-mentioned patents.

The succinate builders are preferably used in the form of their water-soluble salts, including the sodium, potassium, ammonium and alkanolammonium salts.

Specific examples of succinate builders include: laurylsucinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Examples of useful builders also include sodium and potassium carboxymethyloxymalonate, carboxymethyloxysuccinate, cis-cyclohexane-hexacarboxylate, cis-cyclopentane-tetracarboxylate, watersoluble polyacrylates (these polyacrylates having molecular weights to above about 2,000 can also be effectively utilized as dispersants), and the copolymers of maleic anhydride with vinyl methyl ether or ethylene.

Other suitable polycarboxylates are the polyacetal carboxylates disclosed in U.S. Pat. No. 4,144,226, Crutchfield et al., issued Mar. 13, 1979, incorporated herein by reference. These polyacetal carboxylates can be prepared by bringing together, under polymerization conditions, an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Polycarboxylate builders are also disclosed in U.S. Pat. No. 3,308,067, Diehl, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Preferred polycarboxylate builders for use herein having the general formula:

CH(A)(COOX)—CH(COOX)—O—CH(COOX)—CH(COOX)(B)

wherein A is hydroxyl; B is hydrogen or —O—CH(COOX)—$CH_2$(COOX); and X is hydrogen or a salt-forming cation. If B is H, then the compound is tartrate monosuccinic acid (TMS) and its water-soluble lo salts. It is preferred that the above alphahydroxy acid (TMS) be mixed with tartrate disuccinate (TDS) represented by the above chemical structure wherein A is H and B is O—CH(COOX)—$CH_2$(COOX). Particularly preferred are mixtures of TMS and TDS in a weight ratio of TMS to TDS of from about 97:3 to about 20:80, most preferably 80 TMS:20 TDS. These builders are disclosed in U.S. Pat. No. 4,663,071, issued to Bush et al., on May 5, 1987.

Other organic builders known in the art can also be used. For example, monocarboxylic acids, and soluble salts thereof, having long chain hydrocarbyls can be utilized. These would include materials generally referred to as "soaps." Chain lengths of $C_{10}$–$C_{20}$ are typically utilized. The hydrocarbyls can be saturated or unsaturated.

Other Optional Ingredients

A wide variety of other ingredients useful in detergent compositions can be included in the compositions herein, including other active ingredients, other enzymes, soil release agents, soil suspending agents, brighteners, suds suppressors, carriers, hydrotropes, processing aids, dyes or pigments, solvents, bleaches, bleach activators, etc.

The liquid detergent compositions can contain other solvents such as low molecular weight primary or secondary alcohols exemplified by methanol, ethanol, propanol, and isopropanol. Monohydric alcohols are preferred for solubilizing surfactant, but polyols such as those containing from 2 to about 6 carbon atoms and from 2 to about 6 hydroxy groups (e.g., ethylene glycol, and glycerine), can also be used.

The liquid laundry detergent compositions herein are preferably formulated such that they have a pH in a 10% solution in water at 20° C. of between about 6.5 and 11.0, preferably about 7.0 to 9.5. Techniques for controlling pH at recommended usage levels include the use of buffers, alkalis, acids, etc., and are well known to those skilled in the art.

Preferred herein are concentrated liquid detergent compositions. By "concentrated" is meant that these compositions will deliver to the wash the same amount of active ingredients at a reduced dosage. Typical regular dosage of heavy duty liquids is 118 milliliters in the U.S. (about ½ cup) and 180 milliliters in Europe.

Concentrated heavy duty liquids herein contain about 10 to 100 weight % more active ingredients than regular heavy duty liquids, and are dosed at less than ½ cup depending upon their active levels. This invention becomes even more useful in concentrated formulations because there are more actives to interfere with enzyme performance. Preferred are heavy duty liquid laundry detergent compositions with from about 30 to 90, preferably 40 to 80, most preferably 50 to 70, weight % of active ingredients.

The following examples illustrate the compositions of the present invention. All parts, percentages and ratios used herein are by weight unless otherwise specified.

EXAMPLES 1–6

The following liquid laundry detergent compositions are prepared by mixing the ingredients in the order listed. Examples 2–6 are compositions of the present invention. Comparative Example 1 differs from Example 2 in that boric acid is added to the composition of Example 1 after the citric acid. In the table, the following abbreviations are used.

$C_{45}E_{2.25}S$ is $C_{14-15}$ alkyl polyethoxylate (2.25) sulfonic acid $C_{23}E_{6.5}T$ is $C_{12-13}$ alkyl ethoxylate (6.5), topped to remove unexthoxylated and monoethoxylated alcohols MEA is monoethanolamine $C_{24}$ Glucamide is $C_{12-14}$ alkyl N-methyl glucamide TEPA-$E_{15-18}$ is tetraethylene pentaimine ethoxylated with 15–18 moles (avg.) of ethylene oxide at each hydrogen site on each nitrogen Fatty acid is $C_{12-14}$ fatty acid NaTS is sodium tartrate mono- and di-succinate (80:20 mix)

Na Formate is sodium formate

Ca Formate is calcium formate

Protease is Protease B (34g/L) as described above

Cellulase consists essentially of 43 kD endoglucanse described in PCT International Publication Number WO 91/17243 (12 g/L)

SRP is Soil Release Polymer of U.S. Pat. No. 4,968,451

| Ingredient | Ex. 1 | Ex. 2 | Ex. 3 | Ex. 4 | Ex. 5 | Ex. 6 |
|---|---|---|---|---|---|---|
| $C_{45}E_{2.25}S$ | 14.92 | 14.92 | 16.90 | 16.40 | 19.90 | 21.00 |
| Ethanol | 3.60 | 3.60 | 3.60 | 2.88 | 3.60 | 5.00 |
| $C_{23}E_{6.5}T$ | 0.85 | 0.85 | 2.00 | 1.64 | 0.85 | 0.00 |
| MEA | 2.30 | 2.30 | 3.50 | 2.80 | 2.30 | 3.50 |
| Na Formate | 0.24 | 0.24 | 0.30 | 0.24 | 0.24 | 0.45 |
| Brightener | 0.10 | 0.10 | 0.10 | 0.076 | 0.10 | 0.12 |
| $C_{24}$ Glucamide | 4.98 | 4.98 | 3.20 | 0.00 | 0.00 | 7.00 |
| 1,2 Propane diol | 10.00 | 10.00 | 10.00 | 8.00 | 10.00 | 7.00 |
| NaTS | 3.06 | 3.06 | 2.10 | 1.60 | 3.06 | 4.00 |
| Boric Acid | 2.50* | 2.50 | 2.50 | 2.00 | 2.50 | 2.00 |
| NaOH | 2.80 | 2.80 | 2.51 | 2.01 | 2.80 | 3.10 |
| Fatty Acid | 2.30 | 2.30 | 1.25 | 2.00 | 2.30 | 3.00 |
| Citric Acid | 2.91 | 2.91 | 2.60 | 2.08 | 2.91 | 3.80 |
| Ca Formate | 0.09 | 0.09 | 0.09 | 0.07 | 0.09 | 0.00 |
| TEPA-$E_{15-18}$ | 1.14 | 1.14 | 1.14 | 0.91 | 1.14 | 1.50 |
| SRP | 0.00 | 0.00 | 0.00 | 0.00 | 0.00 | 0.50 |
| Water | 47.11 | 47.11 | 47.52 | 56.49 | 47.11 | 37.00 |
| Dye | 0.005 | 0.005 | 0.005 | 0.005 | 0.005 | 0.00 |
| Perfume | 0.25 | 0.25 | 0.25 | 0.20 | 0.25 | 0.00 |
| Protease | 0.60 | 0.60 | 0.50 | 0.40 | 0.60 | 0.80 |
| Cellulase | 0.50 | 0.50 | 0.25 | 0.20 | 0.50 | 0.25 |
| pH of 10% solution | 8.55 | 8.55 | 8.55 | 8.55 | 8.55 | 8.20 |

*In Example 1, boric acid is added just after the citric acid.

The compositions of Examples 1, 2, 3 and 5 are evaluated for stability of the cellulase, measured as a percent of the initial performance provided by the cellulase in the composition, after storage at the indicated temperatures and times. In this evaluation, aged cotton fabrics are washed using the test compositions, tumble dried in an automatic dryer (which is preferred over line drying) and then visually graded by a panel of experts, after multiple wash/dry cycles, for restoration of fabric appearance. The results are as follows.

| % Cellulase Performance Remaining | | | |
|---|---|---|---|
| | | Temperature | |
| | Storage Time, weeks | 21.1° C. | 32.2° C. |
| Example 1: | 2 | 50% | 50% |
| | 5 | 10% | 10% |
| Example 2: | 2 | — | 90% |
| | 4 | 80% | 50% |
| | 8 | 75% | 75% |
| Example 5: | 2 | 75% | — |
| | 4 | 80% | 65% |
| | 8 | 100% | 65% |
| Example 3**: | 4 | — | 40% |

**Made in a much larger quantity than Examples 1, 2 and 5.

From the above, it is seen that the addition of boric acid and 1,2 propane diol to Examples 2 and 5 before adding the citric acid significantly improves cellulase stability versus that in comparative Example 1. Improved cellulase stability is also obtained in Example 3.

What is claimed is:

1. A liquid laundry detergent composition comprising, by weight:

a. from about 5 to 50% of anionic or nonionic surfactant, at least about 25% of which is an ethoxylated or sugar-based surfactant;

b. from about 1 to 10% of citric acid, or a water-soluble salt thereof;

c. from about 1 to 20% of 1,2 propane diol;

d. from about 0.5 to 5% of boric acid or its derivative;

e. from 0.0001 to 1.0% of active proteolytic enzyme;

f. from about 0.0001 to 1.0% of active cellulase enzyme; and g. from about 10 to 75% of water;

wherein said composition is prepared by adding the 1,2 propane diol and boric acid or its derivative to the composition before adding the citric acid or salt thereof to the composition and said composition has a weight ratio of said 1,2 propane diol to boric acid or its derivatives between about 2:1 and 10:1.

2. A liquid detergent composition according to claim 1 comprising from about 10 to 40% of said anionic or nonionic surfactant, at least about 50% of which is an ethoxylated or sugar-based surfactant.

3. A liquid detergent composition according to claim 2 wherein said anionic surfactant is selected from the group consisting of a $C_{12}$ to $C_{18}$ alkyl sulfate, a $C_{12}$ to $C_{18}$ alkyl sulfate ethoxylated with an average of from about 1 to 6 moles of ethylene oxide per mole of alkyl sulfate, a $C_{11}$ to $C_{13}$ linear alkylbenzene sulfonate, and mixtures thereof, and said nonionic surfactant is selected from the group consisting of a condensation product of $C_{13}$–$C_{18}$ alcohol and between 2 and 20 moles of ethylene oxide per mole of alcohol, a polyhydroxy $C_{12}$–$C_{18}$ fatty acid amide and mixtures thereof.

4. A liquid detergent composition according to claim 3 comprising from about 12 to 30% of said anionic or nonionic surfactant, at least about 75% of which is an ethoxylated or sugar-based surfactant.

5. A liquid detergent composition according to claim 4 comprising from about 1.5 to 8% of citric acid, or a water-soluble salt thereof.

6. A liquid detergent composition according to claim 5 comprising from about 3 to 15% of 1,2 propane diol and about 1 to 4of boric acid or its derivative.

7. A liquid detergent composition according to claim 6 comprising from about 5 to 12% of 1,2 propane diol and about 1.5 to 3% of boric acid or its derivative.

8. A liquid detergent composition according to claim 1 comprising from about 0.0005 to 0.3 weight % of active proteolytic enzyme.

9. A liquid detergent composition according to claim 6 comprising from about 0.002 to 0.1 weight % of active proteolytic enzyme.

10. A liquid detergent composition according to claim 9 comprising from about 0.002 to 0.5 weight % of active cellulase enzyme.

11. A liquid laundry detergent composition according to claim 1 wherein the cellulase consists essentially of a homogenous endoglucanase component which is immunoreactive with an antibody raised against a highly purified about 43 kD endoglucanase derived from *Humicola insolens*, DSM 1800, or which is homologous to said about 43 kD endoglucanase.

12. A liquid laundry detergent composition according to claim 11, wherein the endoglucanase component has an endoglucanase activity of at least 50 CMC-endoase units/mg of protein.

13. A liquid laundry detergent composition according to claim 12 wherein the endoglucanase component has an isoelectric point of about 5.1.

14. A liquid laundry detergent composition according to claim 10 wherein the cellulase consists essentially of a homogenous endoglucanase component which is immunoreactive with an antibody raised against a highly purified about 43 kD endoglucanase derived from *Humicola insolens*, DSM 1800, or which is homologous to said about 43 kD endoglucanase.

15. A liquid laundry detergent composition according to claim 14 wherein the endoglucanase component has an endoglucanase activity of at least 50 CMC-endoase units/mg of protein.

16. A liquid laundry detergent composition according to claim 15 wherein the endoglucanase component has an isoelectric point of about 5.1.

17. A liquid laundry detergent composition according to claim 16 having a pH in a 10% solution in water at 20° C. of between about 7.0 and 9.5.

* * * * *